United States Patent [19]

Colmano

[11] 4,345,549

[45] Aug. 24, 1982

[54] STEAM-GENERATOR WITH IMPROVED FACILITIES FOR REPLACEMENT OF PARTS

[75] Inventor: Riccardo Colmano, Legnano, Italy

[73] Assignees: Ansaldo Societa per Azioni, Genoa; C.N.E.N. Comitato Nazionale per l'Energia Nucleare, Rome, both of Italy

[21] Appl. No.: 104,240

[22] Filed: Dec. 17, 1979

[51] Int. Cl.[3] ..... F22B 1/02

[52] U.S. Cl. ..... 122/34; 122/491; 122/DIG. 11; 165/158

[58] Field of Search ..... 122/DIG. 11, DIG. 14, 122/32, 34, 491; 165/158

[56] References Cited

U.S. PATENT DOCUMENTS

| | | | |
|---|---|---|---|
| 3,245,464 | 4/1966 | Ammon et al. | 122/32 X |
| 3,245,633 | 4/1966 | Ammon et al. | 122/32 X |
| 3,443,548 | 5/1969 | Rich et al. | 122/32 |
| 3,937,183 | 2/1976 | Reisacher | 122/34 |
| 4,162,191 | 7/1979 | Cella | 122/34 X |
| 4,200,061 | 4/1980 | Sterk et al. | 122/32 |

*Primary Examiner*—Edward G. Favors
*Attorney, Agent, or Firm*—Seidel, Gonda, Goldhammer & Panitch

[57] ABSTRACT

A steam-generator, particularly to be used in nuclear power stations, with easily detachable parts, especially for the substitution of the tube bundle or a part thereof, comprises five separate portions fastened one to another by means of connections or merely abutting with intermediate sealings. In a substantially cylindrical vessel or housing, defined at the lower end by a distributor chest and at the upper end by a top cover, there are disposed, respectively from the bottom upwards: a heat-exchanger with a bundle of tubes on a common tube-plate, a steam-separator, and a drier unit, which are so supported within the vessel to be readily separable from one another and the vessel by relative vertical displacement therebetween with no interference with the inner wall of the vessel itself. In two alternative embodiments, the distributor chest, i.e. the manifold of the heat-carrier primary medium, is integral either to the heat-exchanger or to the housing.

11 Claims, 8 Drawing Figures

STEAM-GENERATOR WITH IMPROVED FACILITIES FOR REPLACEMENT OF PARTS

BACKGROUND OF THE INVENTION

The present invention relates to steam-generators of the natural-circulation type and in particular refers to those steam-generators which include therein a drier and a steam-separator being mounted in series with a bundle of tubes capable of being removed and replaced as soon as serious damages or defects should appear in it.

Steam-generators for pressurized-water nuclear power stations are known, which are provided with a bundle of about 4000 U-tubes, arranged in such a way that the outer circumference of the bundle is nearly circular and hence could be fitted into the cylindrically shaped steam-generator shell. The tubes in that case are arranged in such a way that one of their end sections fills out a first semicircular region of the boiler tubeplate, whilst the other end section lies in a second semicircular region opposite to the one first mentioned.

The tubes are welded to the boiler tubeplate; the latter is welded in turn at its outer (usually upper) peripheral area to the cylindrical shell of the steam-generator and along its inner (usually lower) peripheral area to the headpiece of the steam-generator, which is so arranged that the flowing heat-carrier medium gets distributed inside the tubes of the bundle of tubes. Inside the steam-generator the aforesaid bundle of tubes is furthermore enclosed in addition in an auxiliary shell which in its upper section (steam-generators have a generally vertical development) carries the steam-separator complex which in general is welded thereon.

This auxiliary shell defines inside the steam-generator two different cavities which are connected together at the end sections. One of these cavities is made cylindrical and contains the bundle of tubes, whilst the other is made annular on the outside and designed to convey the secondary liquid to the bottom of the bundle of tubes. These cavities together with the associate communicating openings are so designed that a chimney draught arises to ensure the return of the fluid evaporating in the steam-generator. Above the steam-separator complex the drier unit is arranged, which in general is welded onto the outer shell of the steam-generator.

Such a steam-generator, when used in the thermonuclear field is generally enclosed in a room defined by massive concrete walls, through which the various pipes pass with the primary and the secondary liquid flowing in and out. In addition, there are also the other generally usual connections for apparatus and instruments.

Although the steam-generator is so designed that during its working life damages and defects should be prevented, it is necessary in practice to provide for such an occurrence. For this purpose various openings are usually incorporated into the outer shell or envelope of the steam-generator, through which inspections and lighter repairs may be carried out, for example, the closing-off of damaged tubes in the tube bundle. But serious defects such as the breakage of a large number of tubes in the tube bundle, require complete substitution of the steam-generator. Such a solution is naturally connected with material cost and the use of time and labour. But above all during this time the plant itself is not available. All this means a heavy cost burden.

In view of the importance of the problem of preventing serious failures or defects in a steam-generator, in particular of nuclear power stations, one might think of solutions which would be directed towards replacing the most sensitive components of the steam-generator, i.e., the tube bundle and hence not the steam-generator as a whole. A first solution among all those solutions hitherto proposed in this respect consists, for example, in the housing of the steam-generator being divided up into three different portions which are connected together mechanically by conventional methods. One could then replace only the portion including the tube bundle and also plan in advance all of the necessary steps such as the cutting of the tubes, the removal of the cladding, the dismantling of the supports and mountings, etc.

Another solution might consist in the steam-generator being divided up into two sections, that is, an upper section with the driers and steam-separators, and a lower section with the tube bundle; this latter in addition might be subdivided into modular elements to be replaced in case of emergency.

But both these attempted solutions show considerable disadvantages which as far as the first mentioned solution is concerned follow from the necessity of having parts of considerable mass and large bulk, to be moved inside the space in which the reactor and the primary system of the power station are accommodated, and having to separate part of the connections to the plant such as mountings, piping, etc. Further disadvantages may be found to derive from the second of the solutions mentioned above, further to the aforesaid steps of movement and conveyance, due to the complicated instrument equipment and the consequent greater probability of defects in the region of the tube bundle.

SUMMARY OF THE INVENTION

Hence a first aim of the present invention consists in developing a steam-generator which, in the case of such failures as resulting in the replacement of the tube bundle, makes unnecessary any movement or displacement of the outer shell (envelope) of the heat-generator itself, with the exception of a top cover only.

A second aim consists in restricting to an absolutely necessary minimum or even totally to exclude any intervention from the outside onto the connections of the steam-generator to the plant, whereby the down-time of the plant itself may be reduced drastically.

A further aim consists in an improvement of the construction of the steam-generator which involves no major alterations with respect to conventional designs and to manufacturing and operating requirements.

With a view to these aims, the object of the invention is to provide a steam-generator being structurally divided up into five different, materially separated parts, which are: a tube bundle with tubeplate, a steam-generator unit, a drier unit, a vessel and a cover for the latter, either the vessel or the tube bundle with the tubeplate being connected directly or indirectly to a distributor housing for the heat-carrier medium. According to the present invention the first three of the aforesaid part-sections are accommodated in the vessel and fitted thereto successively by means of easily removable connections. The vessel is then closed by the cover through a rigid connection by known devices such as a flange which is bolted according to conventional methods.

It should be realized that the above-mentioned steps of assembling and the corresponding steps of dismantling have no interference with the connections and joints between the vessel and the plant. As a consequence any intervention upon the brickwork structures of the room housing the steam-generator is avoided.

BRIEF DESCRIPTION OF THE DRAWINGS

The present invention will be more fully understood from the following detailed description of some embodiments thereof given by way of non-limiting examples, with reference to the attached drawings, in which.

DETAILED DESCRIPTION OF THE PREFERRED EMBODIMENTS

Figure 1:
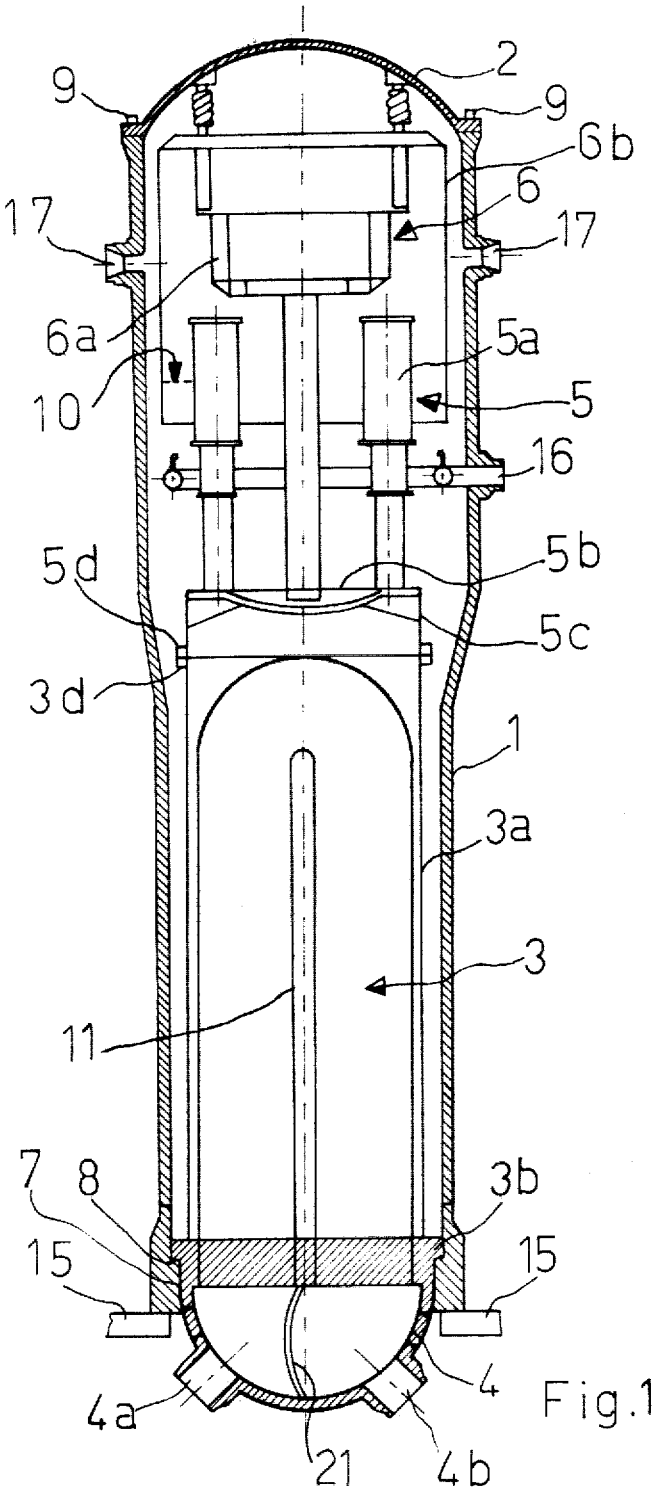
FIG. 1 shows diagrammatically a longitudinal section view of a first embodiment of the steam-generator according to the present invention.

With reference to the drawings, FIG. 1 diagrammatically shows the modular components of which the steam-generator consists and the corresponding connections when the steam-generator is completely assembled and mounted. All of the components of the steam-generator are accommodated inside an outer shell or vessel 1 having on the top a cover 2 and on the bottom a distributor chest 4 with the stubs 4*a* 4*b* through which the heat-carrier liquid is introduced and discharged. Inside the space which is bounded by these parts, considered from the bottom upwards, there may be distinguished a tube bundle 3 with shell 3*a* and tubeplate 3*b*, a steam-separator unit 5 and drier unit 6.

In the embodiment illustrated in FIG. 1 the components 3 and 4 are made integral as the distributor chest 4 is for example welded onto the tubeplate 3*b*. The space therebetween is divided in two by a partition 21 which will be described in greater detail with reference to FIGS. 3 to 7.

The vessel 1 consists of a cylindrical housing having a frustoconical intermediate zone the diameter of which widens upwards. At its upper end section the vessel is formed such as with a flange to which the cover 2 may be fastened by setscrews 9, whereas at its lower end section with a ring-shaped part 7 of a thicker cross-section, inside which there is a ledge 8 upon which the tube-bundle unit 3 as well as the distributor chest 4 integral therewith rests by means of a corresponding projection of the tubeplate. Furthermore in this ledge 8 the necessary grooves are formed for the sealing rings or packings. When the steam-generator is in service, the generated steam imparts its pressure upon the tubeplate 3*b* which is forced against the ledge 8; thus the airtight mechanical connection between the vessel 1 and the complex consisting of the parts 3 and 4 is ensured. In this latter complex a flange 3*d* is provided on the upper part of the shell 3*a* surrounding the tube bundle 3, onto which the steam-separator unit 5 is bolted by means of a corresponding flange 5*d*.

The unit 5 consists of a number (depending upon the capacity of the steam-generator) of cyclone-type separators 5*a*, which are welded onto a supporting plate 5*b*, onto the periphery of which is welded a cylindrical member 5*c* terminating in the above-mentioned flange 5*d* for the attachment to the tube bundle shell 3*a*. Under normal service conditions both the tube bundle and a part of the steam-separator unit are immersed in the water which is the secondary liquid, that is, up to a height of fill in operation indicated by the reference number 10.

The drier unit 6 is arranged in the space overlying the steam-separator unit and consists, for example, of plates of conventional laminated, blade-type driers 6*a* which are arranged upon the vertical sidefaces of one or more cubes or similar bodies. The whole is housed moreover in a cylindrical shell 6*b*, the length of which is dimensioned so that its lower part extends below the fill level 10, i.e. is immersed in the water surrounding the steam-separator for any operating condition. The manner and the means by which the cylindrical shell 6*b* is fastened to the vessel 1 will be described more in detail in the following with reference to FIG. 8.

The connections between the steam-generator and the remainder of the plant are all arranged in the housing of the vessel 1 with the exception of the inlet and outlet pipes for the heat-carrier liquid, which are welded onto the distributor chest 4. This latter, in the embodiment illustrated in FIG. 1, forms an integral component of the unit of the tube bundle 3 and the tubeplate 3*b*. Furthermore the most important connections or joints are shown diagrammatically, with reference to the plant sections external to the steam-generator installation, such as the mounting or support 15 of the steam-generator and the stubs 16 and 17 for the feedwater and the generated steam respectively.

The sequence of the most important operation steps which are necessary in order to dismantle the steam-generator of FIG. 1 is the following:

removal of the cover 2 of the vessel 1 by releasing the setscrews 9.

Removal of the drier unit 6 by simple withdrawal via the top opening.

Releasing the setscrews in the flanges 3*d* and 5*d* on the steam-separator unit 5 and subsequent withdrawal via the opening at the top.

Detaching (by cutting) of the pipes 4*a* and 4*b* which are connected to the distributor chest 4 of the tube bundle.

Removal by lifting out of the unit, consisting of the tube bundle, tubeplate and distributor chest via the top opening.

These dismantling steps are simple mechanical lifting jobs through the use of a pole crane which will probably always be available since it is needed also for other purposes inside the building in which the reactor and the steam-generator are disposed.

Once a defective tube bundle has been removed and hence also the whole unit with the tubeplate and the distributor chest, it substitution is effected by lowering by the same crane the new unit inside the vessel and letting it down onto the corresponding ledge, projection or shoulder 8 which has been provided at the bottom end of the vessel itself. Then the stubs of the distributor chest are welded onto the stubs of the inlet and outlet piping (not shown) for the heat-carrier liquid.

After this step has been terminated, it is sufficient in order to complete the mounting of the steam-generator to build first the steam-separator unit 5 into the vessel 1 again, by setting it down on and bolting the same to the flange 3*d* of the tube bundle shell 3*a*, and then the drier unit 6 by causing it to rest with the projection 11 on the shoulder 12 in the vessel 1 (see FIG. 8) and finally closing the cover 2 of the vessel again.

As it appears from the present description, with a view to the replacement of a damaged tube bundle of a steam-generator, the necessary interventions and measures on the plant structure are restricted to a mere cutting and re-welding process to be carried out onto the piping for the heat-carrier liquid, that is a process which, with special but conventional equipments, can be performed within a very short time. All other steps which are mainly a question of bolting up or unscrewing flange connections as well as hoisting and handling the inner units of the steam-generator, can be performed with the aid of devices which are already provided inside that building in which the so-called primary circuit of a pressurized-water nuclear power station is accommodated.

Figure 2:
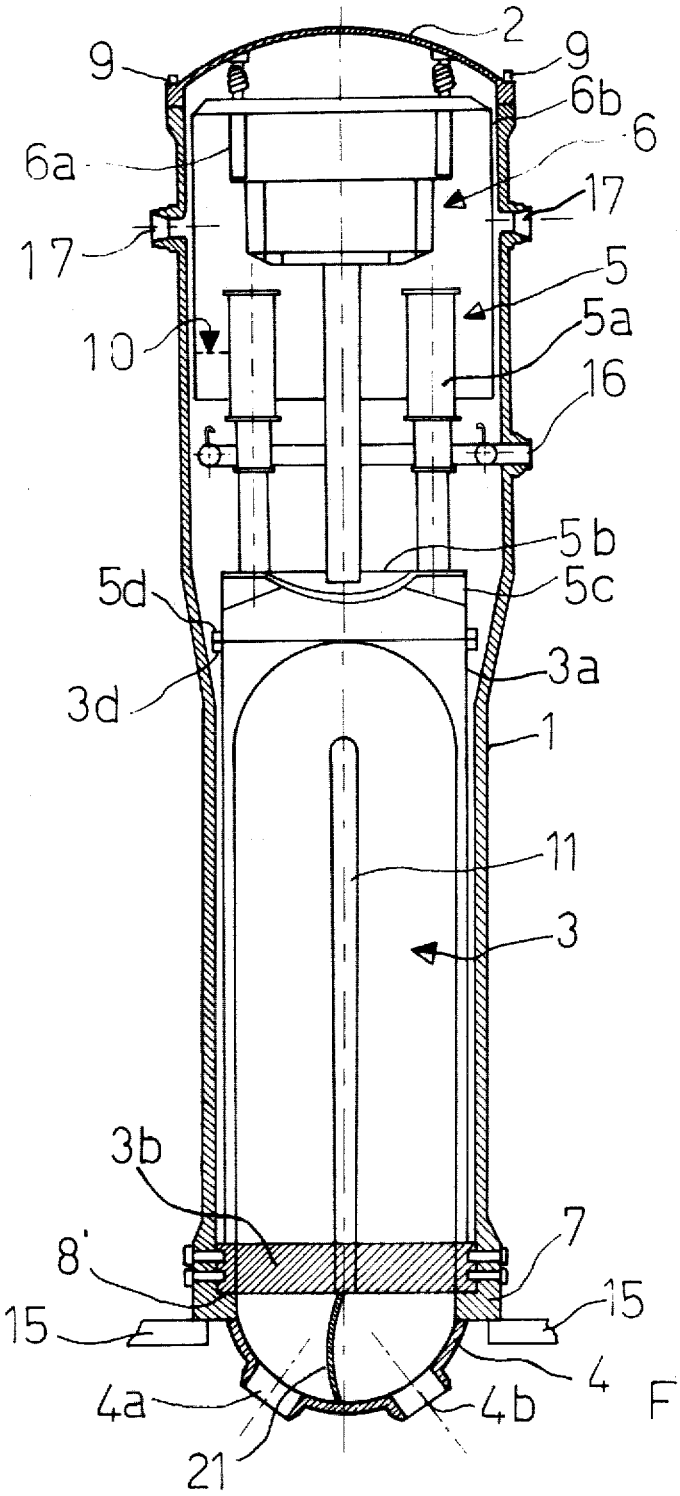
FIG. 2 shows the same cross-section view of a second embodiment of steam-generator of the invention.

With reference to FIG. 2, in which elements similar to those already shown in FIG. 1 are indicated by the same reference numerals, there is shown an alternative embodiment of the steam-generator described above. In this alternative embodiment the distributor chest 4 for the heat-carrier liquid is not welded onto the tubeplate 3*b* but onto the bottom edge 7 of the vessel 1, thus forming an integral component of the vessel itself. The tubeplate 3*b* rests upon the shoulder 8′ in the vessel, to which it is connected through a number of vertical studs capable to be screwed in from below (as shown in detail in FIG. 7). Pins or pegs 18, 18′ and 18″ may also be employed, which as viewed from FIGS. 5 and 6 are arranged radially.

In the embodiment just described and illustrated in FIGS. 2, 5, 6 and 7, the sequence of the steps for the replacement of a defective tube bundle takes place in the same manner as already described in connection with the embodiment of FIG. 1, with the single exception that the step of separating the inlet and outlet pipes for the heat-carrier liquid is not necessary in this case and is substituted by releasing the studs 19 shown in FIG. 7, or withdrawing the pins 18, 18′ and 18″ of FIGS. 5 and 6. In view of the special importances of the connections between the vessel 1 and the complex of the tube bundle, tubeplate and distributor chest, these connections will be described in detail below.

Figure 3:
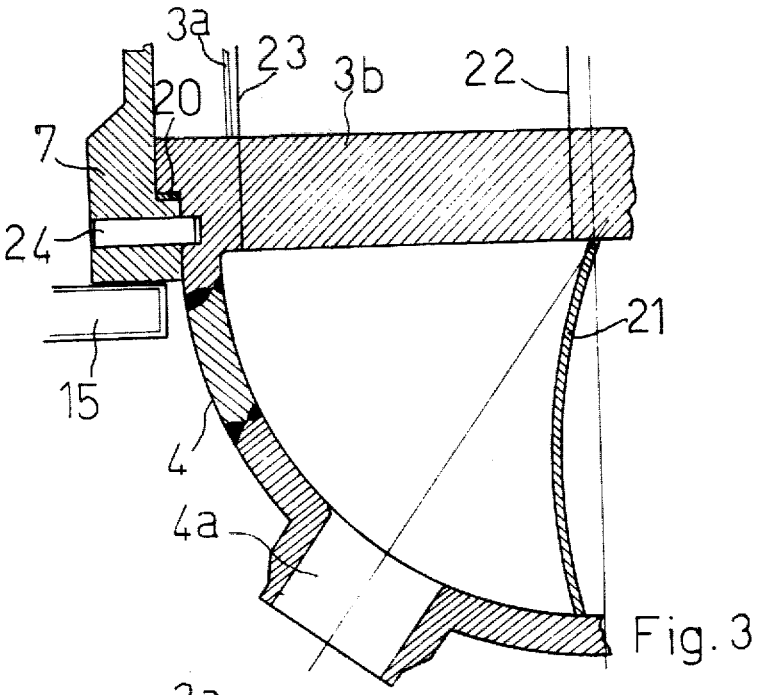
FIGS. 3 and 4 show in detail respectively two different forms of the connection between the tubeplate and the vessel for the steam-generator in accordance with the embodiment illustrated in FIG. 1.
Figure 4:
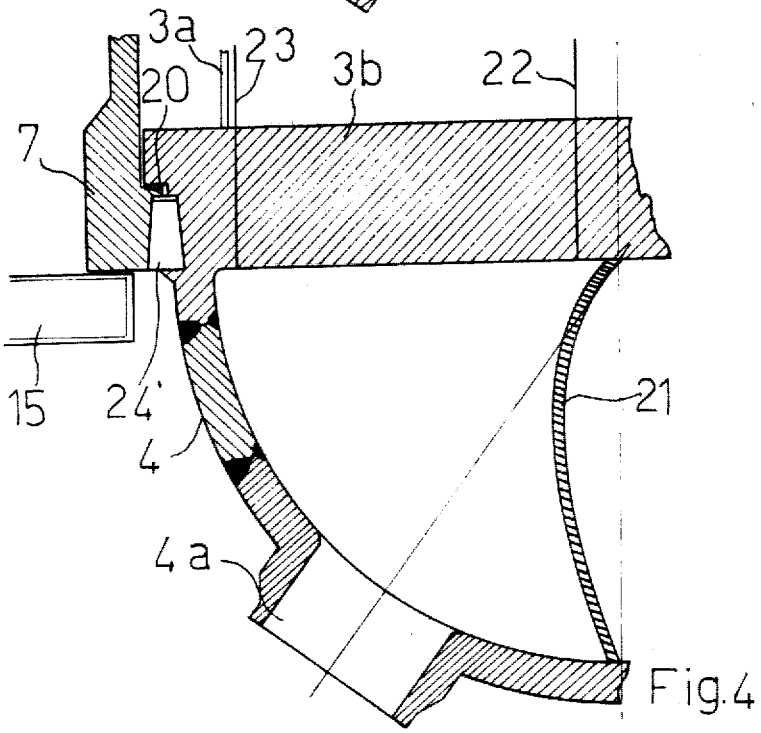

FIGS. 3 and 4 show this connection with reference to the embodiment illustrated in FIG. 1. In detail there may be seen the annular bottom edge 7 of the vessel 1, the seal 20 and one half of the distributor chest 4 separated from the other half by the elastic partition 21. Furthermore for the sake of better clarity only the innermost tube 22 and the outermost tube 23 of the tube bundle are shown, as well as a lower portion of the shell 3*a* of the tube bundle. The steam-generator rests with the underside of the edge 7 on a support 15 to which it may be fastened by bolting. The tube bundle unit 3, with the tubeplate and integral distributor chest 4, rests with the seal 20 on the shoulder 8 inside the bottom edge 7 of the vessel. The relevant connection is ensured by the pressure from the steam generated by the steam-generator during service. In order to ensure this connection even under conditions of catastrophe, for example, during an earthquake which in addition should occur at a time when the steam-generator is not in service, pins have been provided, which as may be seen from FIG. 3 may be inserted radially (24) or vertically (24′) as shown in FIG. 4.

Figure 5:
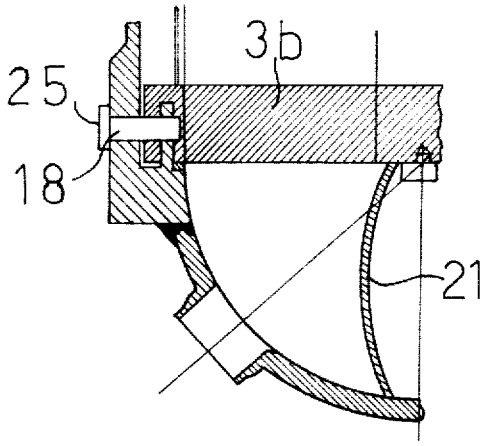
FIGS. 5, 6 and 7 show in detail respectively three other possible forms of the connection between the tubeplate and the vessel of the steam-generator in the embodiment illustrated in FIG. 2.
Figure 6:
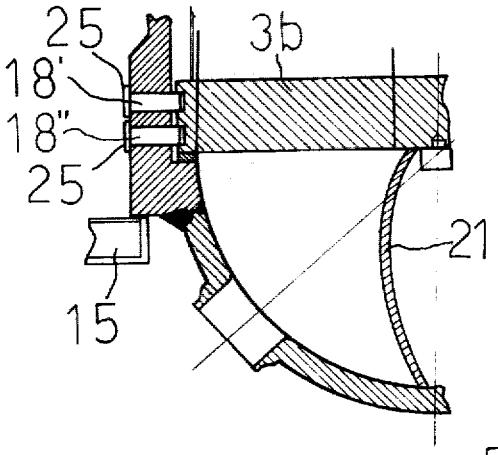
Figure 7:
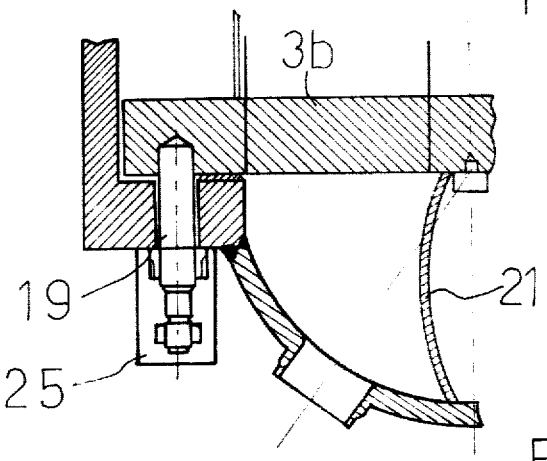

FIGS. 5, 6 and 7 show the connection of the vessel 1 to the unit consisting of the tube bundle and tubeplate 3 as referred to the embodiment illustrated in FIG. 2. As already indicated, here the distributor chest 4 is integral with the vessel 1 and not with the removable tubeplate. In this manner one has the possibility of withdrawing the unit consisting of the tube bundle and tubeplate through the top opening without having to operate upon the vessel from outside and especially with no need of cutting, joining again and rewelding the piping. The tubeplate 3*b* rests on the shoulder 8′ which is provided with seals 20 and the fastening thereto is effected by tierods, studs or pins which are so arranged that sealing during operation of the steam-generator is in any case guaranteed. FIGS. 5 and 6 show two different possibilities of fastening or connection by radial pins, respectively a single pin 18 and two pins 18′, 18″. FIG. 7 on the other hand shows a version of the fastening or connection for the tubeplate 3*b* and hence for the whole tube bundle unit 3 to the vessel 1, by means of vertical studs 19. In order to cause the liquid medium in the steam-generator to be water-tight sealed towards the outside, these studs and tierods or tension members have corresponding metal cap covers 25 which have been welded onto the outer surface of the vessel.

The sealing between the two chambers into which the distributor chest 4 is divided (and which in the embodiment of FIG. 2 has a not stationary ceiling as it is not integrally constructed with the tubeplate) is ensured by the twice curved partition 21 which, where it abuts to the inner wall of the distributor chest, is welded thereto along a continuous line, whilst at the top part it is screwed to the tubeplate according to conventional methods.

Figure 8:
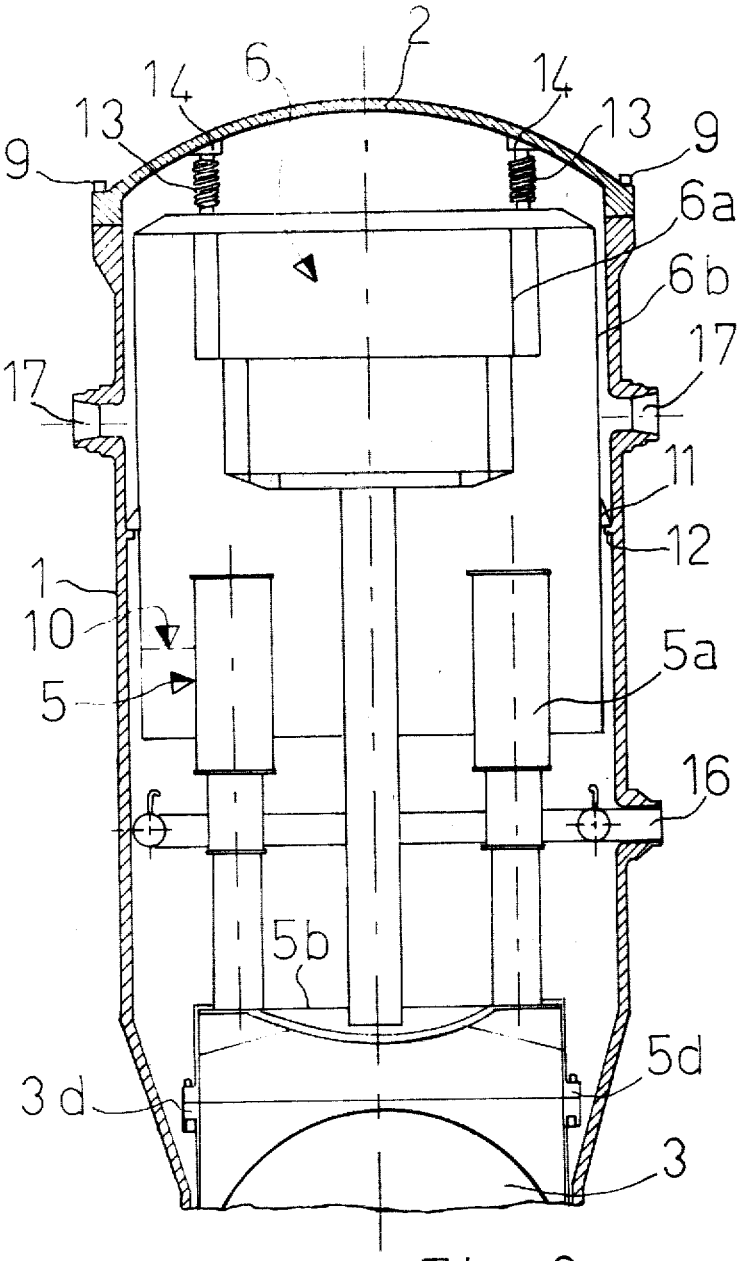
FIG. 8 shows in particular the detachable connection between the tube bundle, the steam-separator unit, the drier unit and the vessel for any embodiment of the steam-generator according to the present invention.

The mechanical connections and joints and the sealing between the tube bundle unit with tubeplate 3 on one hand and the steam-separator unit 5 on the other as well as between the drier unit 6 and the vessel 1, are shown in FIG. 8. Besides the flanges 3*d* and 5*d* for the bolted connection between the complex of the tube bundle and tubeplate 3 on the one hand and the steam-separator unit 5 on the other, there is clearly evident from the figure the circumferential mounting rib 11 on the cylindrical shell 6*b*, which is provided for receiving the corresponding projection 12 which has been formed along the inner wall circumference of the container 1. The parts 11 and 12 are kept into contact with each other by the operation of springs 13 which are compressed between the frame of the drier unit 6 and associated seats 14 which are provided on the inner face of the cover 2. When the steam-generator is completely assembled and mounted and the setscrews 9 have been tightened, the springs 13 are in the compressed state and force the shell 6*b* of the drier unit against the projection or shoulder 12 of the vessel.

The sealing between the space inside the shell 6*b* of the steam-separator and the annular space outside it, which is connected to the steam outlet pipe 17, is ensured by the tight connection between the collar 11 and the projection or shoulder 12 as well as by the fact that the shell 6*b* extends downward until it reaches a level below the height of fill 10 inside the steam-generator zone occupied by the liquid, whereby in this manner an absolutely satisfactory hydrostatic sealing is realized.

Further additions and/or variations upon the embodiments of the steam-generator which are described above and illustrated may be provided by those skilled in the art without exceeding the scope of the invention. In particular the various tierods, pins, mountings, setscrews or pegs may be substituted by mechanically equivalent parts.

What I claim is:

1. A vertical steam-generator having natural circulation in a vertical cylindrical vessel having a removable top cover and containing:

a bundle of U-shaped tubes being fastened to a tubeplate and housed in a shell;

said U-shaped tubes having a primary heat-carrier fluid medium flowing therethrough and being immersed in a secondary fluid medium;

a steam-separator detachably mounted above said bundle of tubes;

a drying unit detachably mounted above said steam-separator and fastened to said vessel by means of springs which are kept under compression by the cover of the vessel;

said cylindrical vessel having at its lower end an inwardly extending annular ledge on which said tubeplate is detachably mounted with water-tight means;

said tubeplate with bundle of tubes and shell being coaxially aligned with said vessel by pin means;

whereby said drying unit, steam-separator and tubeplate with bundle of tubes and shell may be separately removed from said cylindrical vessel by vertical lifting.

2. A steam-generator as in claim 1 wherein said water-tight means comprises an annular seal positioned between the upper surface of said ledge and the lower surface of said tubeplate, said water-tight means being ensured by the steam pressure generated by the steam-generator.

3. A steam-generator as in claim 1 wherein said pin means comprises horizontally oriented pins extending through the wall of said vessel into the side of said tubeplate.

4. A steam-generator as in claim 1 wherein said pin means comprises vertically oriented pins extending through said annular ledge into the bottom edges of said tubeplate.

5. A steam-generator according to either of claims 3 or 4 wherein said pins are provided with cap covers on the outer surface of the vessel to ensure a water-tight seal.

6. A steam-generator as in claim 1 having a distributor chest under said tubeplate for the inlet and outlet of the primary fluid medium, said distributor chest being divided into two chambers by an elastic partition wall.

7. A steam-generator as in claim 6, wherein said inlet and outlet means for the primary liquid are integral to said tubeplate and independent from the vessel.

8. A steam-generator as in claim 6 wherein said inlet and outlet means for the primary liquid are integral with the vessel and independent from said tubeplate.

9. A steam-generator as in claim 1, wherein the steam-separator is flanged onto the shell of the bundle of tubes and secured by setscrews and bolts.

10. A steam-generator as in claim 1, wherein the drying unit is enclosed inside a cylindrical shell having a circumferential overhang arranged to be supported upon a corresponding ring-shaped projection extending inwardly from the inner wall of the vessel and urged against said projection by the action of said springs.

11. A steam-generator as in claim 6, wherein said elastic partition wall by which the distributor chest is divided into two chambers has a double line of curvature, is welded rigidly onto the inner wall of the distributor chest itself and is fastened at the top by setscrews or bolts onto the tubeplate.

* * * * *